United States Patent [19]

Holmgren

[11] 4,024,684

[45] May 24, 1977

[54] PRE-NOTCHED BUILDING PANEL WITH SPLICE PLATE AND METHOD OF PREPARING THE SAME

[75] Inventor: Robert E. Holmgren, Connersville, Ind.

[73] Assignee: H. H. Robertson Company, Pittsburgh, Pa.

[22] Filed: Sept. 20, 1973

[21] Appl. No.: 399,151

Related U.S. Application Data

[63] Continuation-in-part of Ser. No. 149,245, June 2, 1971, abandoned.

[52] U.S. Cl. ..... 52/127; 52/514; 52/631; 52/741

[51] Int. Cl.[2] ..... E02D 35/00

[58] Field of Search ..... 52/631, 100, 127, 173, 52/514, 753 H, 741, 309; 206/321

[56] References Cited

UNITED STATES PATENTS

| | | | |
|---|---|---|---|
| 440,009 | 11/1890 | Caldwell | 206/451 |
| 2,020,455 | 11/1935 | Butler | 52/388 |
| 3,440,790 | 4/1969 | Nerem | 52/631 |
| 3,729,870 | 5/1973 | Kualheim et al. | 52/631 X |

*Primary Examiner*—Price C. Faw, Jr.
*Assistant Examiner*—Carl D. Friedman
*Attorney, Agent, or Firm*—Harry B. Keck; George E. Manias

[57] ABSTRACT

A laminated building panel of the type comprising a metal facing sheet and a backing. The backing is pre-notched and/or cut in the factory to permit field-bending of the panel to produce corner structures. A factory installed splice plate is secured to the building panel to maintain the structural integrity of the panel during handling and shipment to the job site. A method for preparing the panel for shipment to an erection site is described.

10 Claims, 3 Drawing Figures

PRE-NOTCHED BUILDING PANEL WITH SPLICE PLATE AND METHOD OF PREPARING THE SAME

CROSS-REFERENCE TO RELATED APPLICATIONS

This application is a continuation-in-part of pending application Ser. No. 149,245 filed June 2, 1971, now abandoned, and assigned to the assignee of the present invention.

BACKGROUND OF THE INVENTION

1. Field of the Invention

This invention relates to laminated building panels, and more particularly to a prenotched building panel having a rigidifying splice plate, and to method for preparing the panel for shipment to an erection site where the panel is about to produce corner structures.

2. Description of the Prior Art

Wall panels formed from metal facing sheets and a backing, such as a liner sheet and an intermediate core, are used extensively in the construction of various types of enclosures. A prevalent trend in present day panel design is the bending of the panels to produce corner constructions of desired architectural appearance. Numerous methods have been proposed for bending such panels. See U.S. Pat. Nos. 1,440,615 (G. R. MEYERCORD, Jan. 2, 1923); 1,669,667 (J. LEVINE, May 15, 1928); 3,496,689 (M. E. NEREM, Feb. 24, 1970). Basically these methods consist of notching the panel to remove a segment of the backing and thus provide a V-groove having an apex adjacent to the exterior facing sheet. The exterior facing sheet is then bent along the base of the groove to move the exposed faces of the backing into juxtaposition.

It is known to notch and bend the building panel at the factory and to ship the thus formed corner assembly to the job site. It is also known to ship the building panels in a flat condition to the job site where the building panels are notched and bent and thereafter erected. The shipping cost of factory-bent building panels is excessive. Field-notching and field-bending of the panels requires special equipment, abnormally precise work operations and extra labor.

SUMMARY OF THE INVENTION

The principal object of this invention is to provide a building panel which is factory prepared for field-bending and which may be shipped to the job site in a flat condition.

A further object of this invention is to provide a splice plate for maintaining the structural integrity of a pre-notched and/or cut building panel during handling and shipment to the job site.

Still another object of this invention is to provide a method for preparing the building panel for shipment to an erection site.

The present invention is applicable to laminated building panels of the type comprising a facing sheet formed from bendable material, such as sheet metal, and a backing substantially coextensive with the facing sheet. The backing may comprise a liner sheet of any desired material and an insulating core, such as a foamed-in-situ core of polyurethane, disposed between the facing sheet and the liner sheet.

The laminated panel is factory prepared for field-bending, for example, by forming a groove in the backing which terminates proximate to the facing sheet; applying a relatively rigid, temporary splice plate to the backing such that it spans across the groove, and securing the splice plate to the panel. The splice plate maintains the structural integrity of the panel during handling and shipment to the job site.

DESCRIPTION OF THE PREFERRED EMBODIMENT(S)

Figure 1:
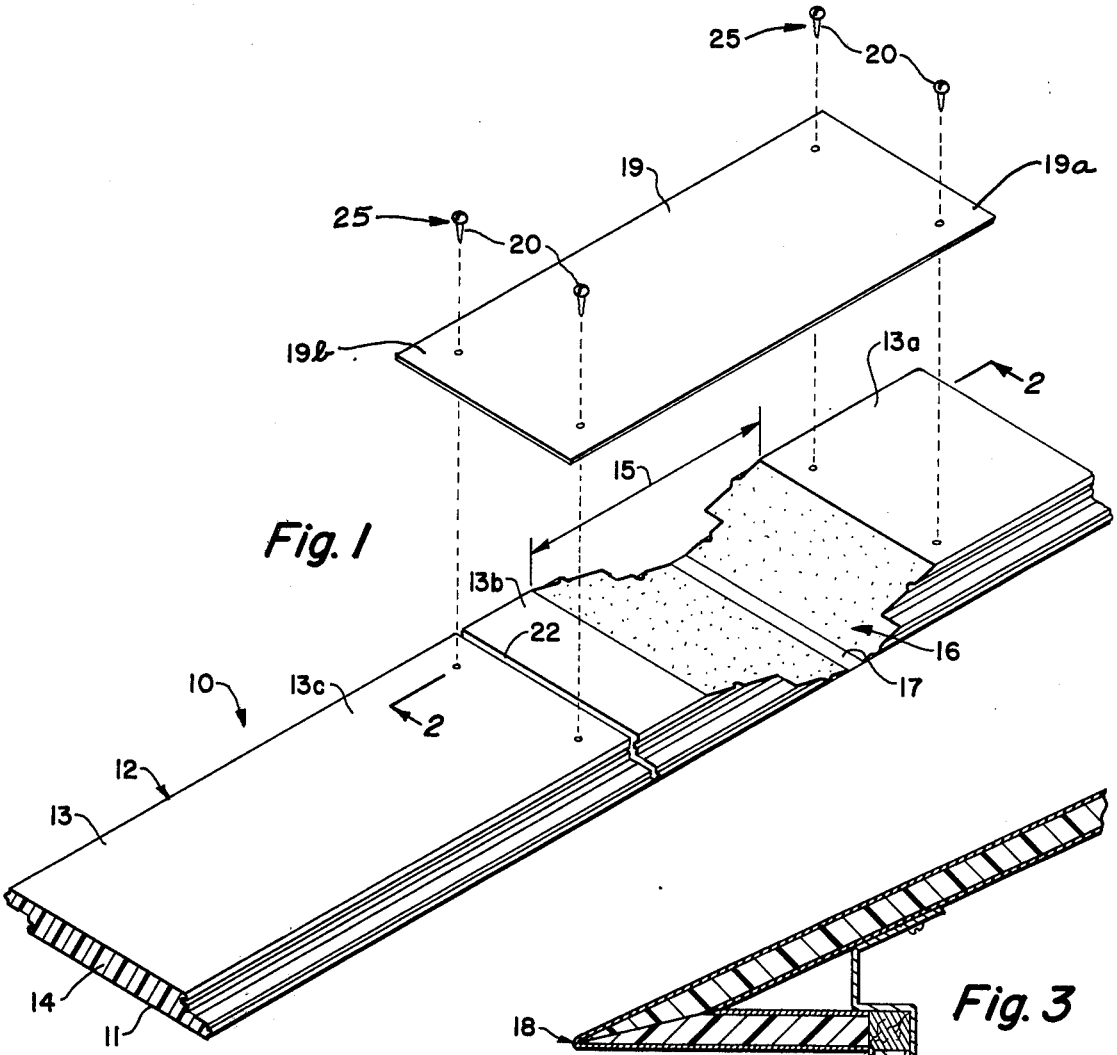
FIG. 1 is an exploded, broken isometric view of a building panel which is factory prepared for field bending, illustrating the splice plate of the present invention.
Figure 2:
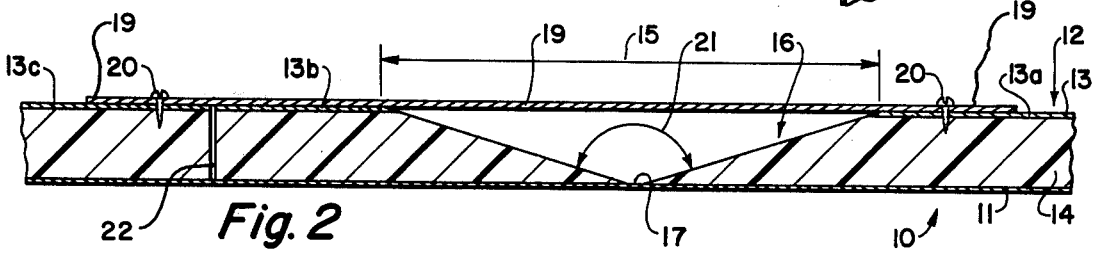
FIG. 2 is a cross-sectional view, taken along the line 2—2 of FIG. 1, illustrating the panel with the splice plate installed.

FIGS. 1 and 2 illustrate a typical building panel 10 comprising an outer facing sheet 11 of any suitable bendable material, such as sheet metal, and a backing 12 having the desired thermal insulating properties. The backing 12 may comprise an inner facing sheet 13 of any suitable material and a low strength, foamed plastic insulating core member 14 filling the space between the facing sheets 11, 13. The core member 14 may be formed by foamed-in-situ techniques from polyurethane. Alternatively, the core member 14 may comprise a preformed block of foamed plastics composition having opposite faces secured to the facing sheets 11, 13 by films of adhesives, for example.

Figure 3:
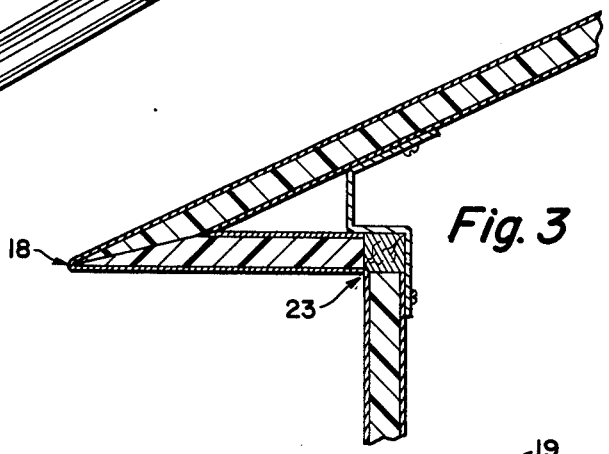
FIG. 3 is a fragmentary cross-sectional view, illustrating the corner structure produced by field-bending the panel of FIGS. 1 and 2.

The panel 10 presents a gap indicated by the dimension line 15, in the backing 12. The gap 15 may be formed only in the liner sheet 13 in which case the liner sheet 13 is divided into separate liner sheet segments **13*a*, 13*b*. Alternatively, the gap 15 may take the form of a V-groove 16 which extends through the liner sheet 13 and the core member 14 and presents an apex 17 proximate to the outer facing sheet 11. In the preferred arrangement, the outer facing sheet 11 is exposed at the apex 17. The panel 10 may be bent in the field, along a line parallel with the apex 17 of the V-groove 16 to provide an outside corner 18 illustrated in FIG. 3.**

It will be appreciated that since the V-groove 16 divides the liner sheet 13 into separate liner sheet segments **13*a*, 13*b*, the structural integrity of the panel 10 in a direction transverse to the groove 16 is reduced. According to the present invention, a splice plate 19 is provided which spans across the gap 15 (V-groove 16) and presents opposite plate ends 19*a*, 19*b* overlying the liner sheet segments 13*a*, 13*b*. Distinct securing means 25 is provided for securing the opposite plate ends 19*a*, 19*b* to the panel 10. Where the liner sheet 13 is formed from sheet metal, the securing means 25 may comprise threaded fasteners 20 which secure the plate ends 19*a*, 19*b* to the liner sheet segments 13*a*, 13*b*, as best shown in FIG. 2. The splice plate 19 reinstates the structural integrity of the panel 10 in a direction transverse to the groove 16,** during handling in the factory and at the job site and during shipment to the job site.

As is conventional, the included angle 21 (FIG. 2) of the V-groove 16 determines the angle of the resultant corner. For example, the included angle 21 is an obtuse angle which results in the acute outside corner 18 illustrated in FIG. 3. It should be apparent that obtuse as well as right angle outside corners may be formed by providing a V-groove of appropriate included angle.

As shown in FIGS. 1 and 2, the panel 10 may also be provided with a narrow gap 22 in the backing 12. The narrow gap 22 may be formed only in the liner sheet 13 in which case the liner sheet 13 is further divided into separate liner sheet segments 13*b*, 13*c*. Alternatively, the narrow gap 22 may, instead, extend through the liner sheet 13 and the core member 14 and terminate proximate to the facing sheet 11. In accordance with the present invention, the splice plate 19 extends across the narrow gap 22 and is secured to the panel 10. It will be observed that to reinstate the structural integrity of the panel 10, it is only necessary for the opposite plate ends 19*a*, 19*b* to extend for a short distance beyond the V-groove 16 and the narrow gap 22. Thus the overall length of the splice plate 19 is less than the overall length of the panel 10.

In the field, the splice plate 19 is removed and the panel 10 is bent in the region of the V-groove 16 to form the acute outside corner 18. A right angle inside corner 23 (FIG. 3) is formed by bending the panel 10 along a line parallel with the narrow gap 22.

In summary, the present invention provides means for maintaining the structural integrity of a pre-notched and precut panel during handling and shipment. The panel is shipped to the job site in a flat condition. All major work preparatory to bending the panel is completed in the factory. Only field bending of the panel is required.

I claim:

1. An unsupported laminated building panel provided in a flat condition and comprising:

a metal facing sheet;

a liner sheet; and a low strength, foamed plastic, insulating core disposed between said facing sheet and said liner sheet;

said panel presenting a gap in said liner sheet which divides said liner sheet into separate liner sheet segments, and which reduces the structural integrity of said panel in a direction transverse to said gap;

a relatively rigid, temporary splice plate spanning across and beyond said gap and having opposite plate ends overlying said separate liner sheet segments, said splice plate having an overall length which is less than the overall length of said building panel; and securing elements distinct from said splice plate and disposed at locations remote from said gap, detachably securing each of said opposite plate ends to said building panel, thereby to temporarily reinstate the structural integrity of said panel in said direction transverse to said gap and to maintain said panel in said flat condition during handling and shipment.

2. The building panel of claim 1 wherein said splice plate is secured to said separate liner sheet segments.

3. The building panel of claim 2 wherein said securing elements comprise threaded fasteners.

4. The building panel of claim 1 wherein said panel presents at least one narrow gap extending through said liner sheet and further dividing said liner sheet; and wherein said splice plate extends across and beyond the first said gap and said narrow gap and is secured to said panel.

5. The building panel of claim 4 wherein said securing elements comprise threaded fasteners.

6. An unsupported laminated building panel provided in a flat condition and comprising:

a metal facing sheet; and a backing including a low strength, foamed plastic, insulating core substantially coextensive with said metal facing sheet;

said panel having a groove which extends through said backing and terminates proximate to said metal facing sheet, and which reduces the structural integrity of said panel in a direction transverse to said gap;

a relatively rigid, temporary splice plate spanning across and beyond said groove and having opposite plate ends overlying said backing, said splice plate having an overall length which is less than the overall length of said building panel; and securing elements distinct from said splice plate and disposed at locations remote from said gap, detachably securing each of said opposite plate ends to said building panel, thereby to temporarily reinstate the structural integrity of said panel in said direction transverse to said gap and to maintain said panel in said flat condition during handling and shipment.

7. A method of preparing a laminated building panel for shipment to an erection site where the panel is bent to produce corner structures, said panel comprising a metal facing sheet and a backing including a low strength, foamed plastic insulating core secured to and substantially coextensive with said metal facing sheet, comprising the steps of forming at least one groove in said backing which terminates proximate to said facing sheet and which reduces the structural integrity of said panel in a direction tranverse to said groove;

applying a relatively rigid, temporary splice plate to said backing which spans across said groove and has opposite plate ends overlying said backing on opposite sides of said groove; and securing each of said plate ends to said panel thereby to temporarily reinstate the structural integrity of said panel during handling and shipment to the erection site.

8. The method of claim 7 wherein said backing includes a liner sheet secured to that face of said insulating core opposite the said metal facing sheet, and wherein forming said groove divides said liner sheet into separate liner sheet segments.

9. The method of claim 8 wherein one of said plate ends is secured to each of said liner sheet segments.

10. The method of claim 8 wherein said opposite plate ends are secured to said liner sheet segments by threaded fasteners.

* * * * *